United States Patent [19]

Russell

[11] 4,414,992

[45] Nov. 15, 1983

[54] HAIR FLUFFING DEVICE

[76] Inventor: Joseph W. Russell, 9465 Hobart Ave., Los Angeles, Calif. 90047

[21] Appl. No.: 351,194

[22] Filed: Mar. 29, 1982

[51] Int. Cl.[3] ..... A45D 24/06

[52] U.S. Cl. ..... 132/129; 132/135; 132/11 R; 132/138

[58] Field of Search ..... 132/11 R, 46 A, 126–132, 132/135–142, 160; 24/DIG. 9, 248 R, 252 R, 252 B

[56] References Cited

U.S. PATENT DOCUMENTS 1,094,013 4/1914 Peterson ..... 132/138

2,149,214 2/1937 Fuscaldo et al. ..... 132/46 A

FOREIGN PATENT DOCUMENTS 1049705 12/1953 France ..... 132/129

*Primary Examiner*—C. Fred Rosenbaum

*Assistant Examiner*—Sherri Vinyard

*Attorney, Agent, or Firm*—Erik M. Arnhem

[57] ABSTRACT

A hair fluffing device comprising two comb like elements pivotally interconnected such that in the unstressed condition the teeth of one of the combs lie substantially along and between the teeth of the other comb. There is a resilient member mounted between the holding parts of the two combs to cause the teeth of the combs to separate when pressure is applied to the holding parts.

4 Claims, 3 Drawing Figures

HAIR FLUFFING DEVICE

BACKGROUND OF THE INVENTION

Field of the Invention

The invention relates to a hair fluffing or lifting device basically consisting of a unit of two pivotally coacting combs, being briefly and successively inserted in sections of the hair of a person. The device, when so inserted, is manipulated to lift the hair, which then becomes fluffy and airy enhancing the general appearance of the hair.

Commercially available hair lifting devices simply consist of a single comb designed as an aid to give more body to the hair by setting it in the hair for as long as the fluffy appearance is desired. Attempts to make intersecting combs for the above stated purpose have hitherto appeared unsuccessful inasmuch as the design of the device causes the hair to become entangled between the intersecting teeth and also have a tendency to split hair ends.

Summary of the Invention

In addition to what was stated under (d) above, the device, according to the invention, comprises two combs mounted pivotally onto each other. A spring is "sandwiched" between the two combs, which, when not under tension, maintains the teeth of the combs, respectively in a planar and intersecting position. When the handles of the combs are depressed, the spring is put under tension and the teeth of the combs separate. The device with its teeth in planar position is inserted in the hair, the handles of the combs are squeezed, causing the combs to expand and thereby "lifting" or fluffing the hair. When the comb handles are released, the teeth will again intersect and are ready to be reinserted into another section of the hair.

DESCRIPTION OF THE INVENTION

Figure 1:
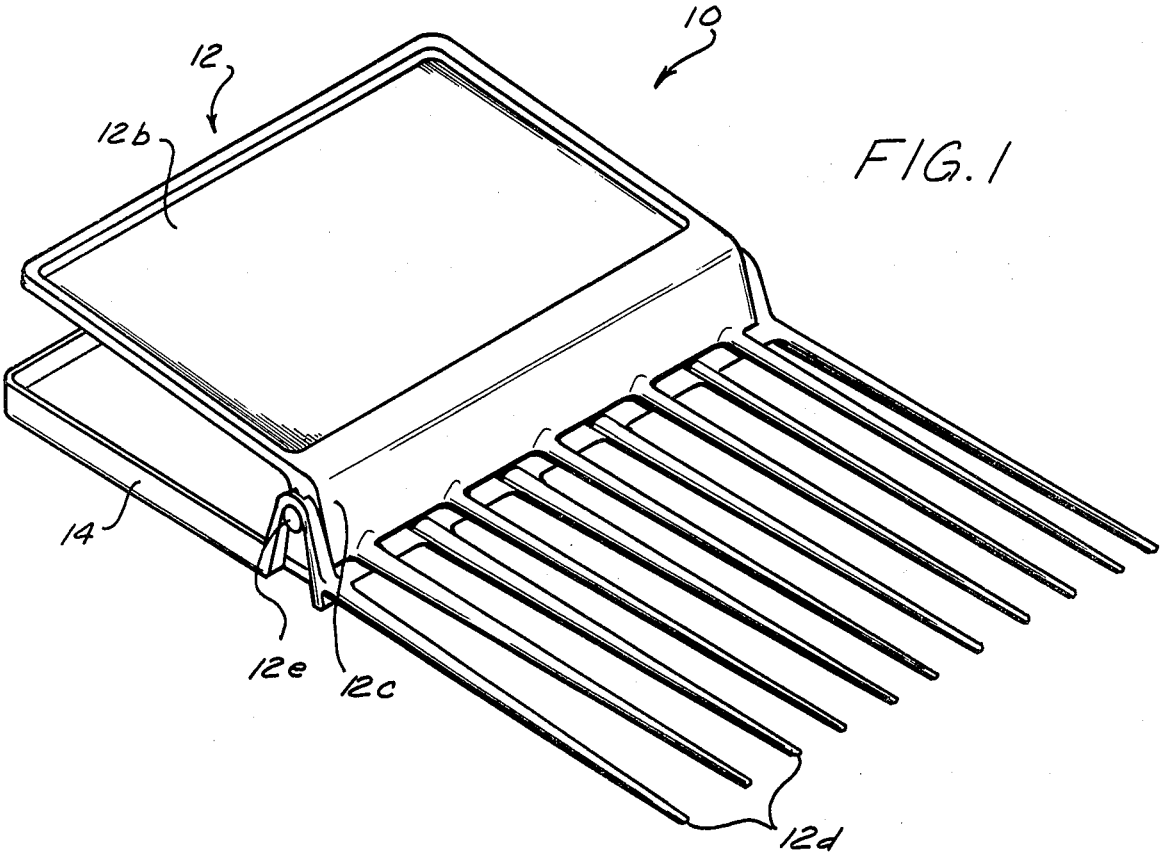
FIG. 1 is a perspective top view of the device, according to the invention.

In the drawings like reference characters designate similar parts in the several views of the drawings.

Figure 2:
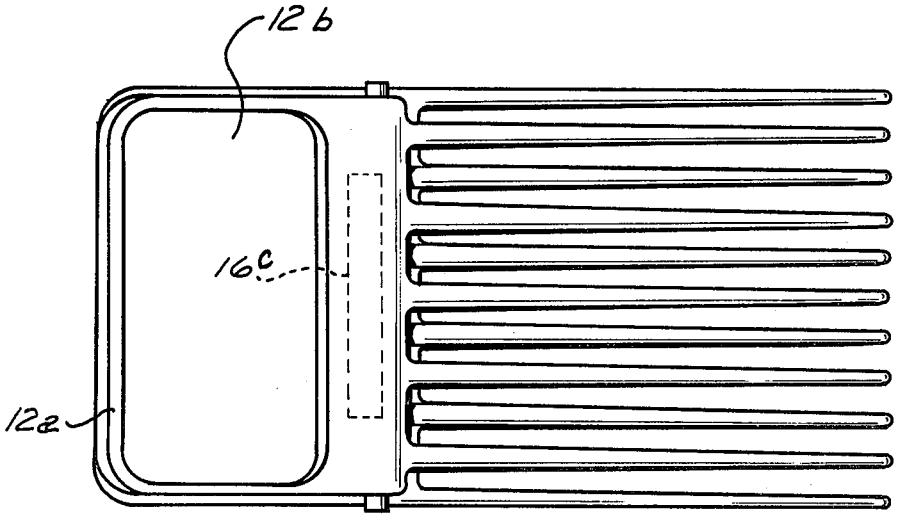
FIG. 2 is a plan top view of the hair fluffing device.
Figure 3:
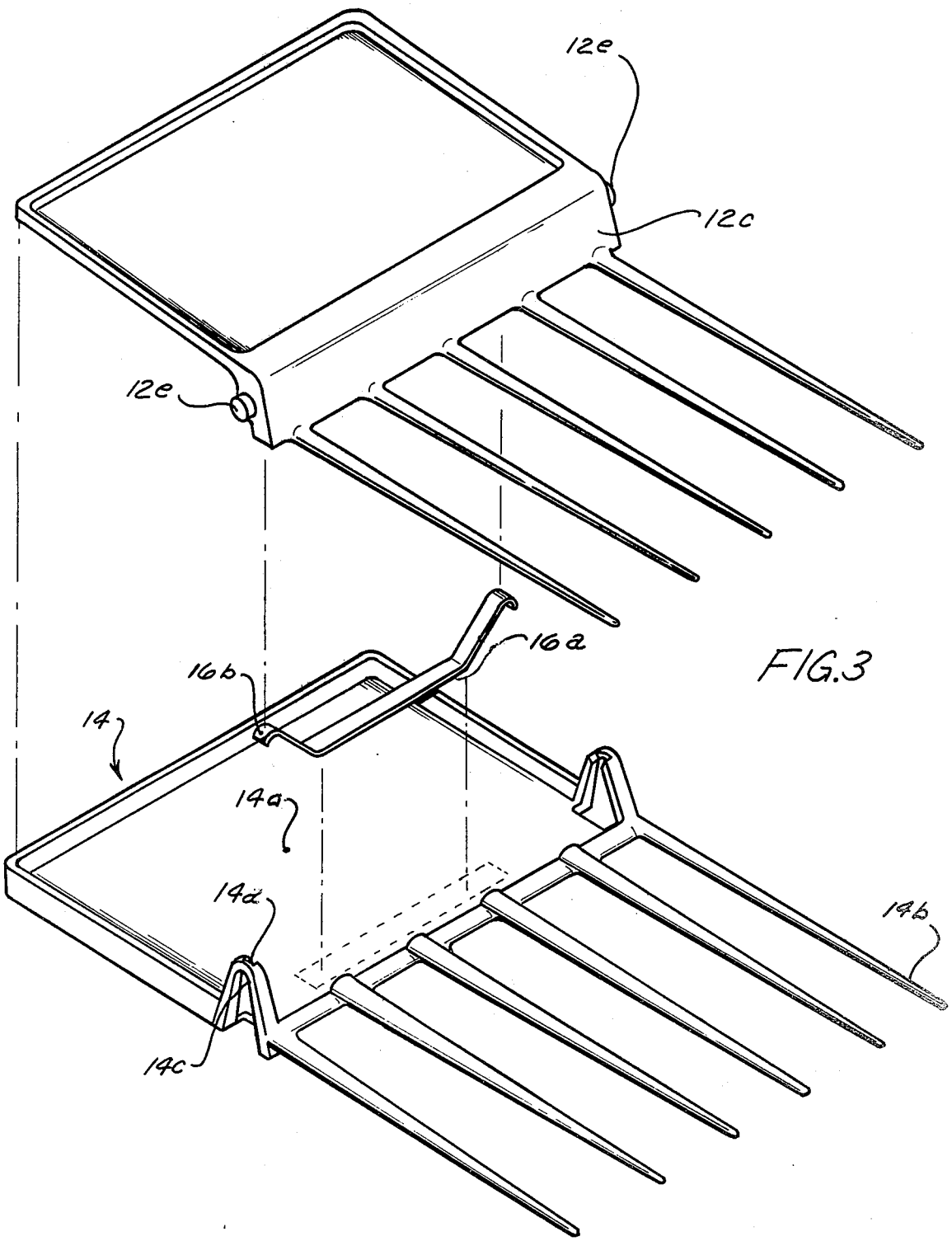
FIG. 3 is a perspective exploded view of the device.

In FIG. 1, numeral 10 indicates the hair fluffing device in its entirety, consisting of three basic components, an upper comb 12, a lower comb 14, and resilient means 16 "sandwiched" between the two combs 12, 14 (FIGS. 2, 3).

Comb 12 has preferably a substantially rectangular holding part **12*a*, suitably provided with a depression 12*b* on its surface (FIG. 1) to facilitate the manipulation of the device; part 12*a* extends at one of its edges rectangularly downward at 12*c* and then parallel with holding part 12*a* into a multiplicity of teeth 12*d*, forming a number of "hills" and "valleys", equally spaced from one another. Pivoting means, e.g., two pins 12*e* integrally project, respectively from each side of holding part 12*a* at 12*c* (FIG. 1) for pivotal mounting onto comb 14**, as will be explained in more detail further on.

Resilient means, e.g., a leaf spring 16 is provided, its center portion **16*a* being substantially flush and suitably fastened across the inner surface of part 14*a*, e.g., parallel with pins 12 (FIG. 2) so that its "legs" or ends 16*b* will extend freely (FIG. 3) towards the lower surface of part 12*a*. 16*c* (FIG. 2) indicates the approximate area where spring 16 is located between the two combs 12, 14**.

Comb 14 comprises a rectangular holding part **14*a*, extending substantially planar into a multiplicity of teeth 14*b*, forming "hills" and "valleys" equally spaced from one another. Comb 14 corresponds substantially in size to that of comb 12**.

Two upwardly extending loop-like projections **14*c* are provided opposite one another (FIG. 3) at the boundary area between section 14*a* and teeth 14*b***.

Loop-like projections **14*c* are respectively provided with resilient V- or U-shaped cuts at 14*d*. When comb 12 is superposed on comb 14, pin ends 12*e* are caused to snap into cuts 14*d* of loops 14*c*, forming "hinges" on which combs 12,14** can pivot in relation to one another.

Prior to activating the combs 12, 14, the leaf spring 16, "sandwiched" between the combs, lightly touches the lower surface of holding part **12*a* (FIG. 3), putting the combs under slight tension, so as to maintain teeth 12*d* and 14*b* in an intersecting position, i.e., the "valleys" of teeth 12*d* are receiving the "hills" of teeth 14*b* and vice versa, as indicated above. When the user of the device, holding it e.g., between the thumb and index finger inserts same selectively in the hair, and exerts pressure on holding parts 12*a* and 14*a* teeth 12*d*, 14*b* will separate, causing the hair to fluff out. On removing the device from the hair and releasing holding parts 12*a*, 14*a*, teeth 12*d*,14*b*** will revert to their original intersecting position for possible reinsertion into another part of the hair.

The device is preferably made of a synthetic material, e.g., polycarbonate.

Preferable dimensions of device 10 are as follows:

Lengths of combs 12, 14, resp. approximately 5"

Widths of combs 12, 14, resp. approximately 3"

Lengths of teeths **12*c*, 14*b***, resp. approximately 3½"

Distance between teeths **12*c*, 14*b***, resp. approximately 0.250"

Widths of teeth **12*c*, 14*b***, resp. approximately 0.180"

While the foregoing has illustrated and described what is now contemplated to be the best mode of carrying out the invention the description is, of course, subject to modifications without departing from the spirit and scope of the invention. Therefore, it is not desired to restrict the invention to the particular constructions illustrated and described, but to cover all modifications that may fall within the scope of the appended claims.

I claim:

1. A hair fluffing device, insertable in the hair, comprising:

(a) a first comb including a holding part with teeth extending therefrom, wherein said teeth all lie in a single plane;

(b) a second comb including a holding part with teeth extending therefrom and lying substantially in a single plane, wherein said second comb is pivotally interconnected with said first comb such that in the normal, unstressed condition the lengths of the teeth of said first comb substantially occupy the space formed along and between the lengths of the teeth of said second comb;

(c) resilient means mounted between the holding parts of said first and second combs causing the teeth of each of said combs to separate when pressure is exerted on said holding parts of said combs.

2. A hair fluffing device, according to claim 1, wherein the holding part of said first comb has a substantially rectangular shape and an edge portion, which extends downward from and then parallel with the rectangular portion of said holding part into the teeth of said first comb, and two pins, respectively projecting from the opposite ends of the downward extending portion of the holding part of said first comb.

3. A hair fluffing device, according to claim 2, wherein the holding part of said second comb is substantially rectangular and lies substantially planar with the teeth of said second comb and the opposite ends at the boundary area between said teeth and holding part are, respectively provided with upwardly extending loops, the top portions of which, respectively have substantially U-shaped cuts, into which the pins of said first holding part may snap to form a pivotal connection between said combs.

4. A hair fluffing device, according to claim 3, wherein the resilient means is a leaf spring having a substantially flush center portion, one surface of which being mounted to the inner surface of the holding part of said second comb, and outwardly turning legs which touch, substantially unstressed, the inner surface of the holding part of said first comb, when no pressure is exerted on the combs.

* * * * *